US009979094B1

(12) United States Patent
Izadian et al.

(10) Patent No.: US 9,979,094 B1
(45) Date of Patent: May 22, 2018

(54) FED DUEL OPEN ENDED WAVEGUIDE (DOEWG) ANTENNA ARRAYS FOR AUTOMOTIVE RADARS

(71) Applicant: Waymo LLC, Mountain View, CA (US)

(72) Inventors: Jamal Izadian, San Jose, CA (US); Russell Smith, Santa Clara, CA (US)

(73) Assignee: Waymo LLC, Mountain View, CA (US)

( * ) Notice: Subject to any disclaimer, the term of this patent is extended or adjusted under 35 U.S.C. 154(b) by 330 days.

(21) Appl. No.: 14/977,926

(22) Filed: Dec. 22, 2015

(51) Int. Cl.
*H01Q 13/00* (2006.01)
*H01Q 21/00* (2006.01)

(52) U.S. Cl.
CPC ..... *H01Q 21/0037* (2013.01)

(58) Field of Classification Search
CPC ..... H01Q 5/42; H01Q 21/064; H01Q 1/3233; H01Q 21/065; G01S 2013/9321; G01S 13/931; G01S 13/87; G01S 7/03; G01S 2013/9375; G01S 2013/9389; G01S 2013/9378
See application file for complete search history.

(56) References Cited

U.S. PATENT DOCUMENTS

2004/0090290 A1* 5/2004 Teshirogi ..... H01Q 13/22 333/237
2005/0146479 A1* 7/2005 Stenger ..... H01P 1/047 343/772
2006/0164315 A1* 7/2006 Munk ..... H01Q 21/005 343/776
2011/0248884 A1* 10/2011 Yano ..... H01Q 1/42 342/175
2014/0240186 A1* 8/2014 Zhou ..... H01Q 13/06 343/772
2014/0266977 A1* 9/2014 Redd ..... H01Q 15/244 343/911 R

* cited by examiner

*Primary Examiner* — Jessica Han
*Assistant Examiner* — Jae Kim
(74) *Attorney, Agent, or Firm* — McDonnell Boehnen Hulbert and Berghoff LLP

(57) ABSTRACT

The radar system include a plurality of radiating elements arranged in a linear array configured to radiate electromagnetic energy. The radar system also includes a waveguide configured to guide electromagnetic energy between (i) each of the plurality of radiating elements and (ii) a waveguide feed. The radiating elements are coupled to a first side of the waveguide. The radar system additionally includes a waveguide feed configured to couple the electromagnetic energy between the waveguide and a component external to the waveguide. The waveguide feed is coupled to the second side of the waveguide at a position between two of the radiating elements. Further, the radar system includes a power dividing network defined by the waveguide and configured to divide the electromagnetic energy injected by the waveguide feed based on a taper profile.

15 Claims, 8 Drawing Sheets

FED DUEL OPEN ENDED WAVEGUIDE (DOEWG) ANTENNA ARRAYS FOR AUTOMOTIVE RADARS

BACKGROUND

Unless otherwise indicated herein, the materials described in this section are not prior art to the claims in this application and are not admitted to be prior art by inclusion in this section.

Radio detection and ranging (RADAR) systems can be used to actively estimate distances to environmental features by emitting radio signals and detecting returning reflected signals. Distances to radio-reflective features can be determined according to the time delay between transmission and reception. The radar system can emit a signal that varies in frequency over time, such as a signal with a time-varying frequency ramp, and then relate the difference in frequency between the emitted signal and the reflected signal to a range estimate. Some systems may also estimate relative motion of reflective objects based on Doppler frequency shifts in the received reflected signals. Directional antennas can be used for the transmission and/or reception of signals to associate each range estimate with a bearing. More generally, directional antennas can also be used to focus radiated energy on a given field of view of interest. Combining the measured distances and the directional information allows for the surrounding environment features to be mapped. The radar sensor can thus be used, for instance, by an autonomous vehicle control system to avoid obstacles indicated by the sensor information.

Some example automotive radar systems may be configured to operate at an electromagnetic wave frequency of 77 Giga-Hertz (GHz), which corresponds to millimeter (mm) electromagnetic wave length (e.g., 3.9 mm for 77 GHz). These radar systems may use antennas that can focus the radiated energy into tight beams in order to enable the radar system to measure an environment with high accuracy, such as an environment around an autonomous vehicle. Such antennas may be compact (typically with rectangular form factors; e.g., 1.3 inches high by 2.5 inches wide), efficient (i.e., there should be little 77 GHz energy lost to heat in the antenna, or reflected back into the transmitter electronics), and inexpensive and easy to manufacture.

In some scenarios, efficiency may be difficult to achieve in systems that are also inexpensive and easy to manufacture. Some inexpensive and easy to manufacture options may involve integrating an antenna into a circuit board (e.g., with a "series-fed patch array"), which is used by many off-the-shelf automotive radars. However, such antennas may lose much of their energy into heating up the substrate of the circuit board. Antennas with the lowest loss may include all-metal designs, but typical all-metal antennas, such as slotted waveguide arrays, can be difficult to manufacture with the small geometries compatible with 77 GHz operation.

SUMMARY

In one aspect, the present application describes a radar system. The radar system may include a plurality of radiating elements arranged in a linear array. The radiating elements are configured to radiate electromagnetic energy. The radar system also includes a waveguide configured to guide electromagnetic energy between (i) each of the plurality of radiating elements and (ii) a waveguide feed. The waveguide has a height dimension and a length dimension. The waveguide also has a first side and a second side opposite the first side, where the first and second sides are orthogonal to the height dimension and parallel to the length dimension. The radiating elements are coupled to the first side of the waveguide. The radar system additionally includes a waveguide feed configured to couple the electromagnetic energy between the waveguide and a component external to the waveguide. The waveguide feed is coupled to the second side of the waveguide at a location along the length dimension of the waveguide corresponding to a position between two of the radiating elements. Further, the radar system includes a power dividing network defined by the waveguide and configured to divide the electromagnetic energy injected by the waveguide feed based on a taper profile. Each radiating element receives a portion of the electromagnetic energy based on the taper profile.

In another aspect, the present application describes a method. The method may involve propagating electromagnetic energy via a waveguide between (i) each of the plurality of radiating elements and (ii) a waveguide feed. The plurality of radiating elements may be arranged in a linear array and the waveguide may have a height dimension and a length dimension. The waveguide may also have a first side and a second side opposite the first side, where the first and second sides are orthogonal to the height dimension and parallel to the length dimension. The radiating elements are coupled to the first side of the waveguide. The method also includes coupling at least a portion of the electromagnetic energy between the waveguide and a component external to the waveguide by a waveguide feed. The waveguide feed is coupled to the second side of the waveguide at a location along the length dimension of the waveguide corresponding to a position between two of the radiating elements. The method further includes dividing the electromagnetic energy from the waveguide feed based on a taper profile, where each radiating element receives a portion of the electromagnetic energy based on the taper profile. Additionally, the method includes radiating at least a portion of the coupled electromagnetic energy via each radiating element, where each radiating element has an associated amplitude and phase.

In yet another aspect, the present application describes a radar unit configured to operate in one of two modes. The radar unit includes a waveguide feed. In a first mode the waveguide feed is configured to couple electromagnetic energy for transmission by the radar unit from outside the radar unit into a waveguide of the radar unit and in a second mode the waveguide feed is configured to couple electromagnetic energy received by the radar unit from the waveguide inside the radar unit out of the radar unit. The radar unit also includes a plurality of radiating structures coupled to a first side of a waveguide. In the first mode the plurality of radiating structures is configured to transmit electromagnetic energy from a waveguide and in the second mode the plurality of radiating structures is configured to receive electromagnetic energy and coupling the received electromagnetic energy into the waveguide. Additionally, the radar unit includes a waveguide layer configured to propagate electromagnetic energy via the waveguide. In the first mode the waveguide layer is configured to propagate electromagnetic energy for transmission by the radiating structures from the waveguide port and in the second mode the waveguide layer is configured to propagate electromagnetic energy received by the radiating structures to the waveguide port. Further, the waveguide feed is coupled to a second side of the waveguide at a location along a length dimension of the waveguide corresponding to a position between two of the plurality radiating elements.

In still another aspect, a system is provided that includes a means for radiating electromagnetic energy. The system may further include means for propagating electromagnetic energy via a guiding means between (i) each of the plurality of radiating means and (ii) a feed means. The plurality of radiating means may be arranged in a linear array and the guiding means may have a height dimension and a length dimension. The guiding means may also have a first side and a second side opposite the first side, where the first and second sides are orthogonal to the height dimension and parallel to the length dimension. The radiating means are coupled to the first side of the waveguide. The system also includes means for coupling at least a portion of the electromagnetic energy between the guiding means and a component external to the guiding means by a feed means. The feed means is coupled to the second side of the guiding means at a location along the length dimension of the guiding means corresponding to a position between two of the radiating means. The system further includes means for dividing the electromagnetic energy from the feed means based on a taper profile, where each radiating means receives a portion of the electromagnetic energy based on the taper profile. Additionally, the system includes radiating at least a portion of the coupled electromagnetic energy via each radiating means, where each radiating means has an associated amplitude and phase.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
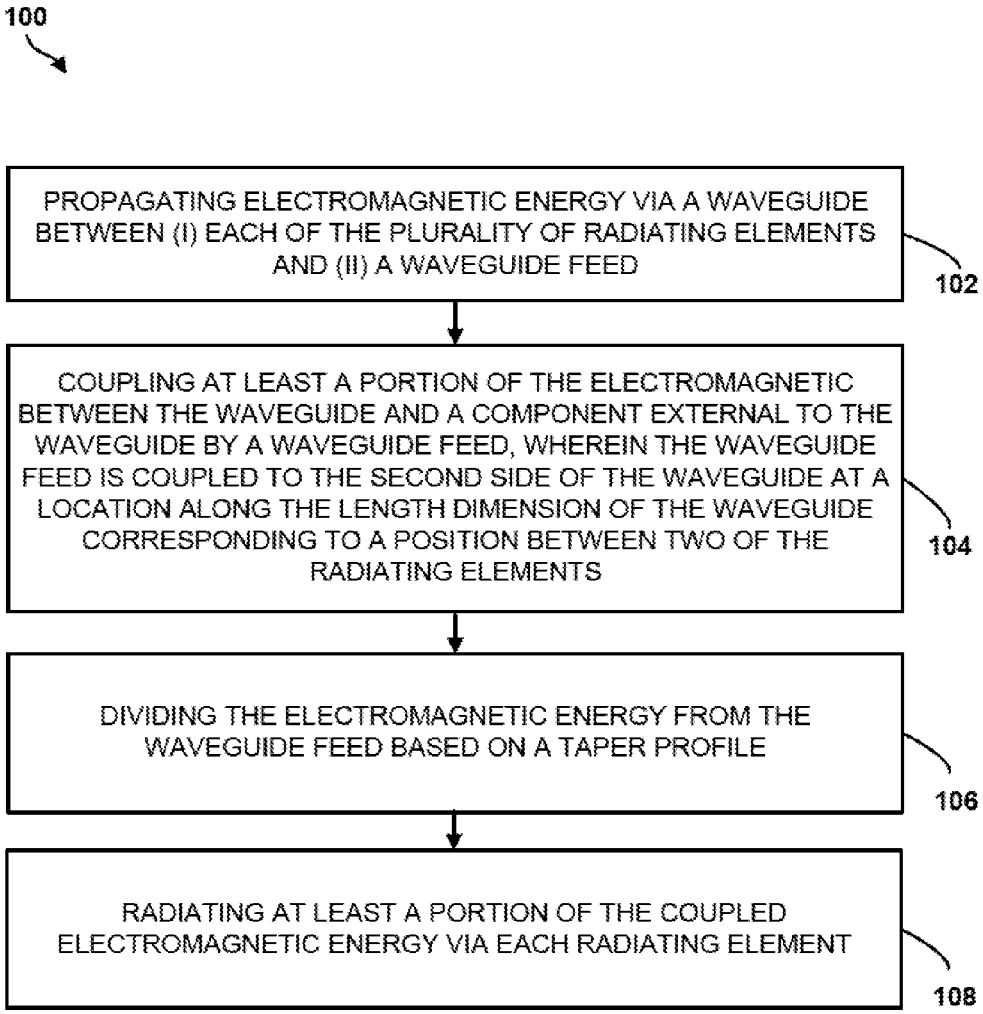
FIG. 1 is a flowchart of an example method to radiate electromagnetic energy.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The following detailed description discloses an apparatus for a "dual open-ended waveguide" (DOEWG) antenna for a radar system for an autonomous vehicle, for instance, and a method for fabricating such an antenna. In some examples, the term "DOEWG" may refer herein to a short section of a horizontal waveguide channel plus a vertical channel that splits into two parts, where each of the two parts of the vertical channel includes an output port configured to radiate at least a portion of electromagnetic waves that enter the antenna.

An example DOEWG antenna may comprise, for example, two metal layers (e.g., aluminum plates) that can be machined with computer numerical control (CNC), aligned properly, and joined together. The first metal layer may include a first half of an input waveguide channel, where the first half of the first waveguide channel includes an input port that may be configured to receive electromagnetic waves (e.g., 77 GHz millimeter waves) into the first waveguide channel. The first metal layer may also include a first half of a plurality of wave-dividing channels. The plurality of wave-dividing channels may comprise a network of channels that branch out from the input waveguide channel and that may be configured to receive the electromagnetic waves from the input waveguide channel, divide the electromagnetic waves into a plurality of portions of electromagnetic waves (i.e., power dividers), and propagate respective portions of electromagnetic waves to respective wave-radiating channels of a plurality of wave-radiating channels. The two metal layers may be called a split block construction.

Further, the first metal layer may include a first half of the plurality of wave-radiating channels, where respective wave-radiating channels may be configured to receive the respective portions of electromagnetic waves from the wave-dividing channels, and where first halves of the respective wave-radiating channels include at least one wave-directing member configured to propagate sub-portions of electromagnetic waves to another metal layer.

Moreover, the second metal layer may include second halves of the input waveguide channel, the plurality of wave-dividing channels, and the plurality of wave-radiating channels. The second halves of the respective wave-radiating channels may include at least one pair of output ports partially aligned with the at least one wave-directing member and configured to radiate the sub-portions of electromagnetic waves propagated from the at least one wave-directing member out of the second metal layer. More particularly, a combination of a given wave-directing member with a corresponding pair of output ports may take the form of (and may be referred to herein as) a DOEWG, as described above.

While in this particular example the antenna includes multiple wave-dividing channels and multiple wave-radiating channels, in other examples the antenna may include, at a minimum, only a single channel configured to propagate all the electromagnetic waves received by the input port to one or more wave-radiating channels. For instance, all the electromagnetic waves may be radiated out of the second metal layer by a single DOEWG. Other examples are possible as well.

A waveguide feed may be located on the opposite side of the waveguide from the element feeds for each radiating doublets. In practice, the element feed may be located on the top of the waveguide and the waveguide feed may be located on the bottom of the waveguide. During operation of the waveguide, the waveguide feed may be configured to provide electromagnetic energy to the feed waveguide for transmission by the radiating elements and the waveguide feed may be configured to couple electromagnetic energy received from the radiating elements outside of the feed waveguide.

The waveguide feed may be located at a position along the length of the feed waveguide. For example, in traditional waveguide systems, electromagnetic energy may be fed at one of the ends of the length of the waveguide in a direction corresponding to the length of the waveguide. By feeding a waveguide at the end, power division to achieve the taper profile may be more difficult. As disclosed herein, the waveguide can instead be fed from the bottom of the waveguide, in a direction orthogonal to the direction of the length of the waveguide. Further, by feeding the waveguide from the bottom at a point along the length, it may be easier to design the power splitting network for the system.

Furthermore, while in this particular example, as well as in other examples described herein, the antenna apparatus may be comprised of two metal layers, it should be understood that in still other examples, one or more of the channels described above may be formed into a single metal layer, or into more than two metal layers that make up the antenna. Still further, within examples herein, the concept of electromagnetic waves (or portions/sub-portions thereof) propagating from one layer of a DOEWG antenna to another layer is described for the purpose of illustrating functions of certain components of the antenna, such as the wave-directing members. In reality, electromagnetic waves may not be confined to any particular "half" of a channel during certain points of their propagation through the antenna. Rather, at these certain points, the electromagnetic waves may propagate freely through both halves of a given channel when the halves are combined to form the given channel.

In some embodiments discussed herein, the two metal layers may be joined directly, without the use of adhesives, dielectrics, or other materials, and without methods such as soldering, diffusion bonding, etc. that can be used to join two metal layers. For example, the two metal layers may be joined by making the two layers in physical contact without any further means of coupling the layers.

In some examples, the present disclosure provides an integrated power divider and method by which each waveguide that feeds a plurality of radiating doublets of a DOEWG may have its associated amplitude is adjusted. The amplitude may be adjusted based on a pre-defined taper profile. Additionally, the present DOEWG may be implemented without complicated manufacturing process. For example, a Computerized Numerical Control (CNC) machining process may be implemented to make the above-described adjustments in parameters such as height, depth, multiplicity of step-up or step-down phase adjustment components, etc. Yet further, the present disclosure may enable a much more accurate method of synthesizing a desired amplitude and phase to cause a realized gain, sidelobe levels, and beam pointing for the antenna apparatus, as compared to other types of designs.

Referring now to the figures, FIG. 1 is a flowchart of an example method 100 to radiate electromagnetic energy. It should be understood that other methods of operation not described herein are possible as well.

It should also be understood that a given application of such an antenna may determine appropriate dimensions and sizes for various machined portions of the two metal layers described above (e.g., channel size, metal layer thickness, etc.) and/or for other machined (or non-machined) portions/components of the antenna described herein. For instance, as discussed above, some example radar systems may be configured to operate at an electromagnetic wave frequency of 77 GHz, which corresponds to millimeter electromagnetic wave length. At this frequency, the channels, ports, etc. of an apparatus fabricated by way of method 100 may be of given dimensions appropriated for the 77 GHz frequency. Other example antennas and antenna applications are possible as well.

Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

Moreover, the method 100 of FIG. 1 will be described in conjunction with the other Figures. At block 102, the method 100 includes propagating electromagnetic energy (e.g., 77 GHz millimeter electromagnetic waves) via a waveguide between (i) each of a plurality of radiating elements and (ii) a waveguide feed. The geometry of the waveguide includes the waveguide having a height dimension and a length dimension. Additionally, the waveguide geometry has a first side and a second side opposite the first side. The first and second sides of the waveguide are orthogonal to the height dimension and parallel to the length dimension. The plurality of radiating elements may be arranged in a linear array and be coupled to the first side of the waveguide. For example, a waveguide may have a straight shape and the radiating elements may be aligned along the length of the waveguide.

At block 104, the method 100 includes coupling at least a portion of the electromagnetic between the waveguide and a component external to the waveguide by a waveguide feed, wherein the waveguide feed is coupled to the second side of the waveguide at a location along the length dimension of the waveguide corresponding to a position between two of the radiating elements.

At block 106, the method 100 includes dividing the electromagnetic energy from the waveguide feed based on a taper profile. Each radiating element of the plurality of radiating elements receives a portion of the electromagnetic energy based on the taper profile.

At block 108, the method 100 includes radiating at least a portion of the coupled electromagnetic energy via each radiating element. Each radiating element radiates a portion of the coupled electromagnetic energy based on an associated amplitude and phase for each respective radiating element defined by the taper profile.

Figure 2A:
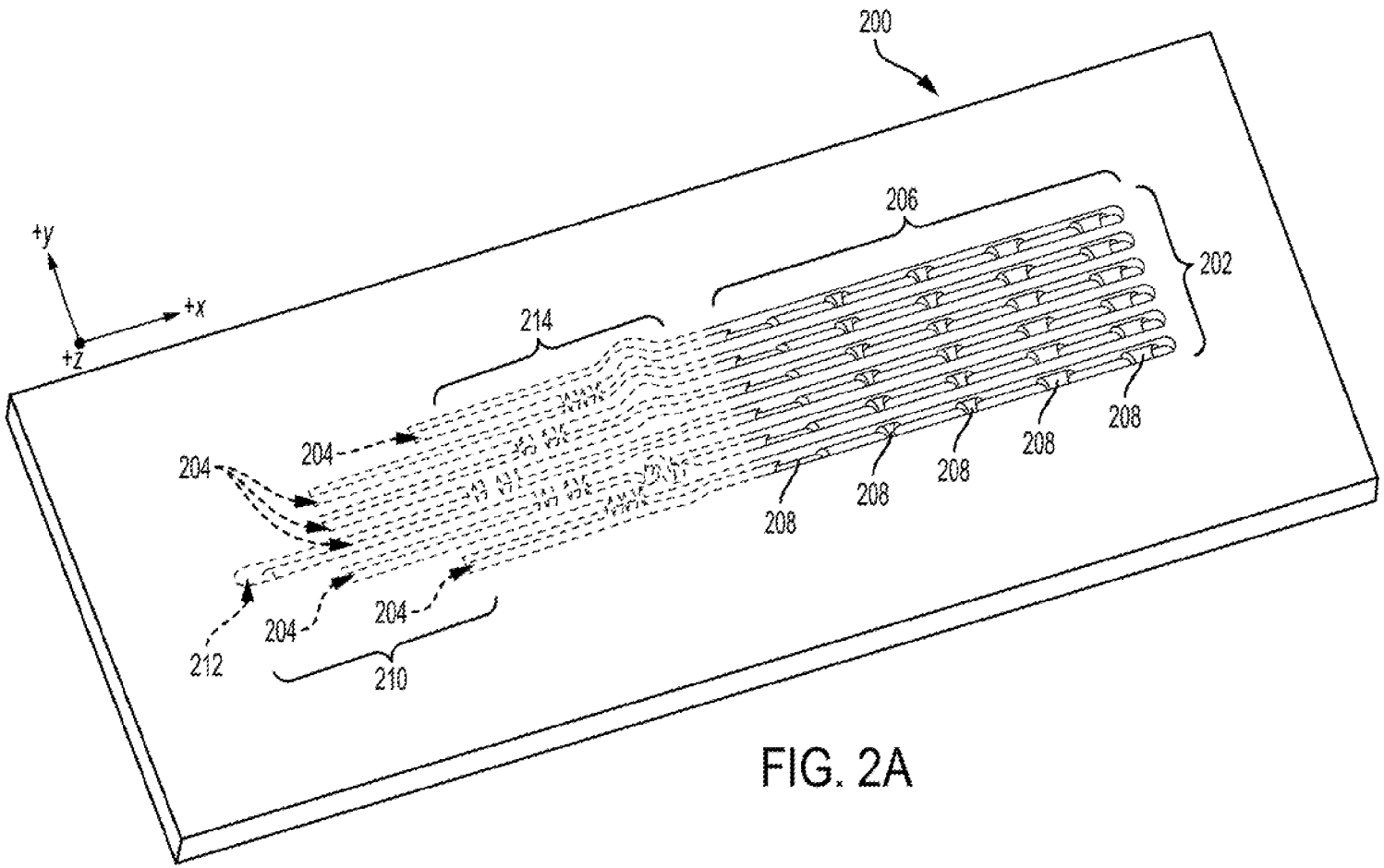
FIG. 2A illustrates a first layer of an example antenna, in accordance with an example embodiment.
Figure 2B:
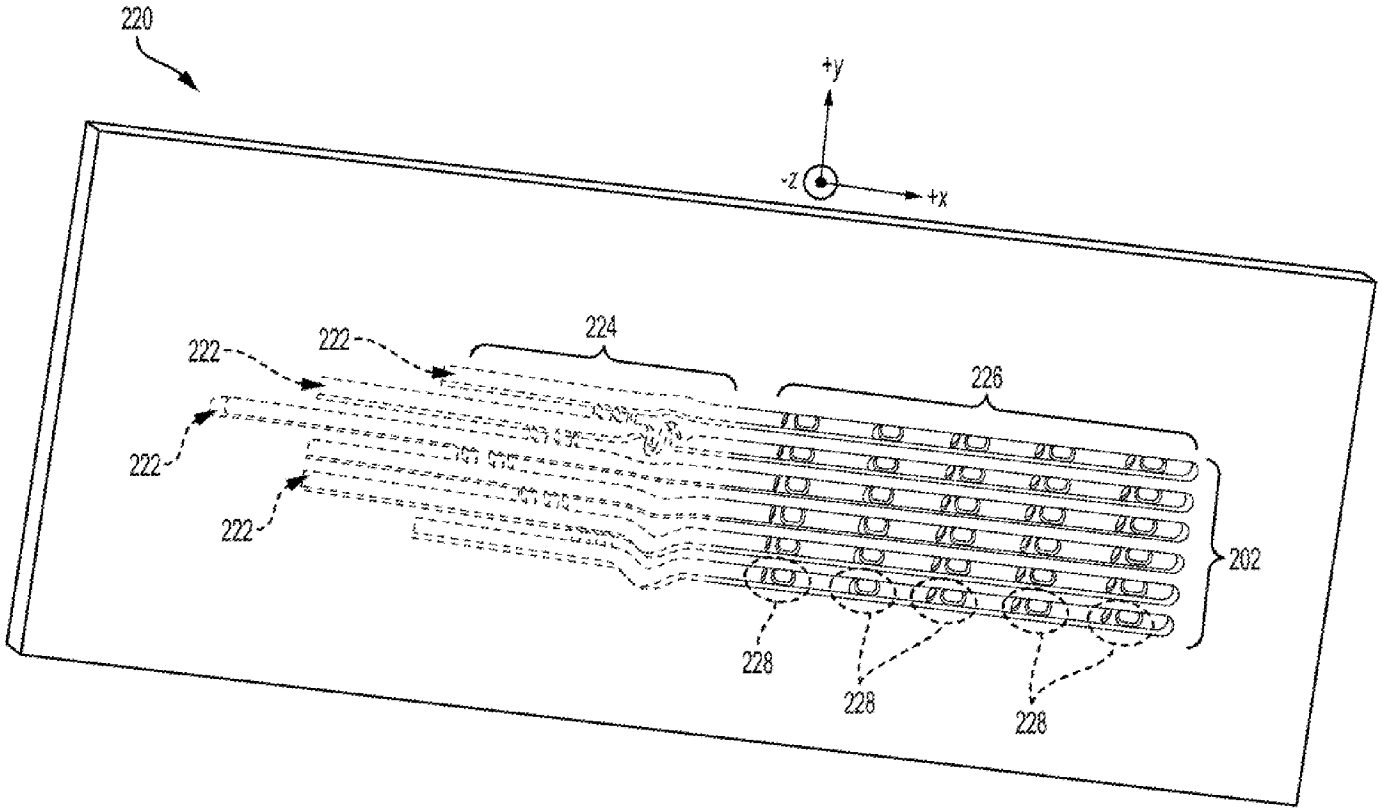
FIG. 2B illustrates a second layer of an example antenna, in accordance with an example embodiment.
Figure 2C:
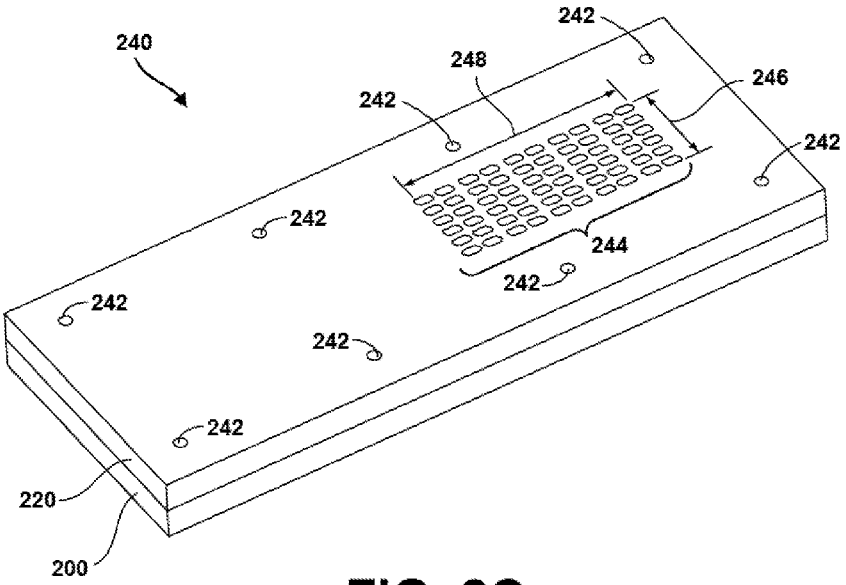
FIG. 2C illustrates an assembled views of an example antenna, in accordance with an example embodiment
Figure 2D:
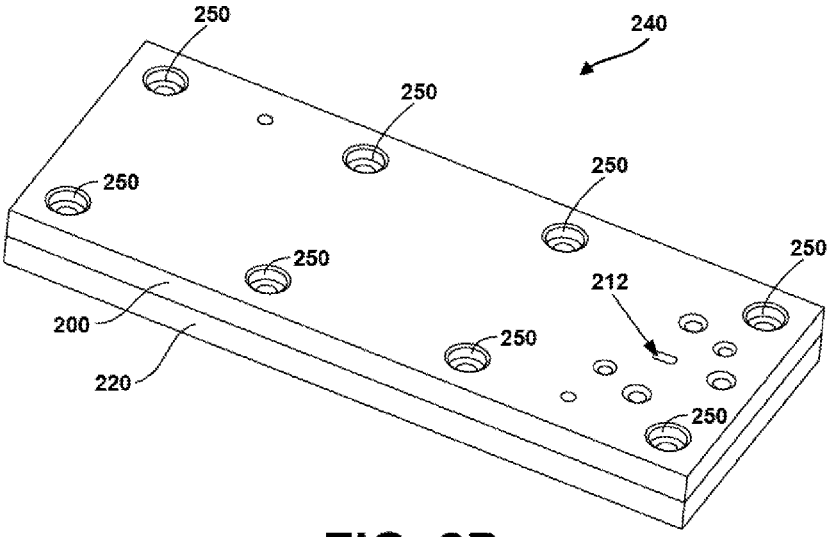
FIG. 2D illustrates an assembled views of an example antenna, in accordance with an example embodiment.
Figure 2E:
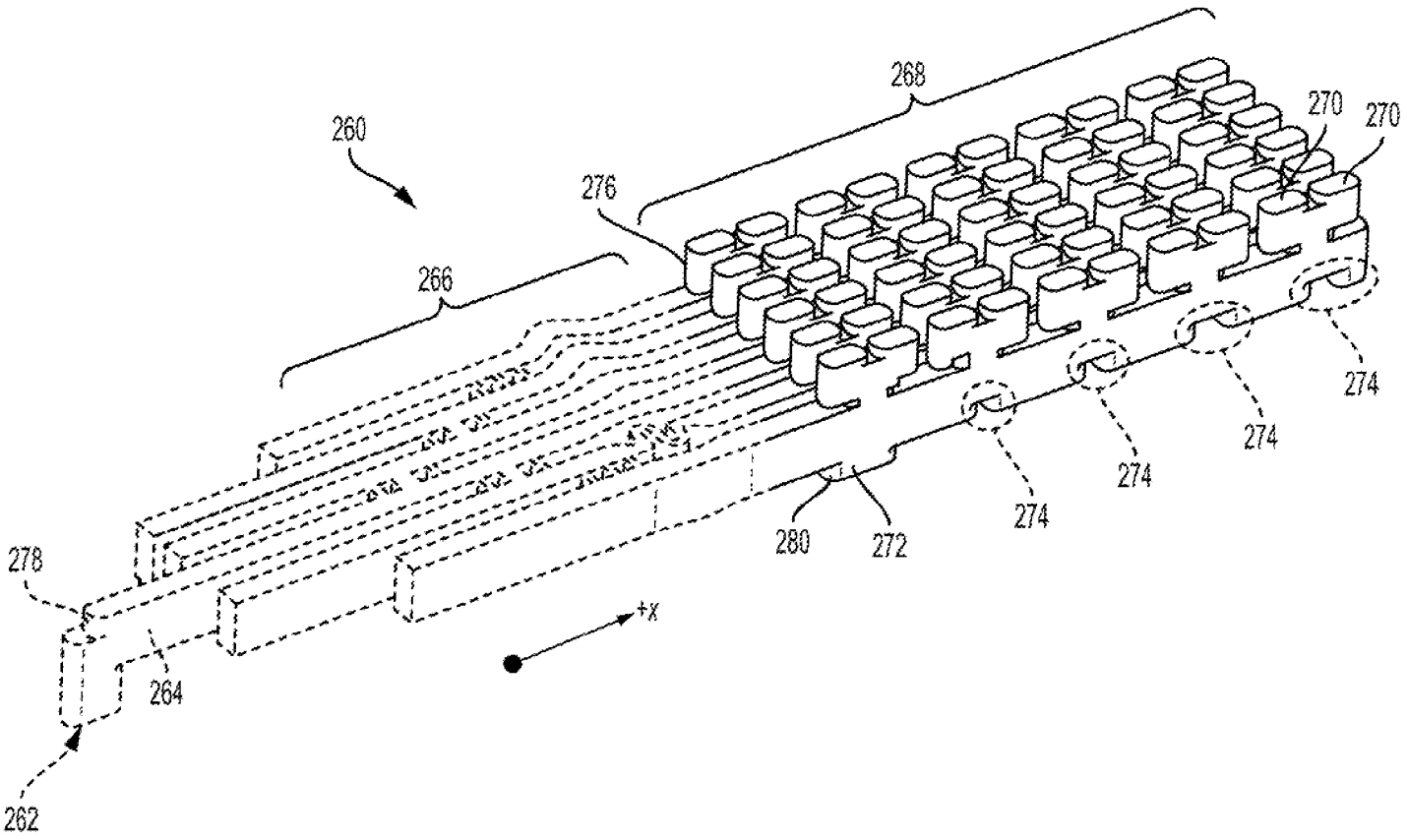
FIG. 2E illustrates conceptual waveguide channels formed inside an assembled example antenna, in accordance with an example embodiment.

Some components illustrated in of FIGS. 2A, 2B, and 2E are shown using broken lines, including elongated segments 204, second end 210, and power dividers 214. The components shown in broken lines are described herein with respect to the alignments shown in the respective figures. However, these components may have altered geometries and/or locations within the context of the disclosure.

FIG. 2A illustrates an example first metal layer 200 including a first half of a plurality of waveguide channels 202. These waveguide channels 202 may comprise multiple elongated segments 204. At a first end 206 of each elongated segment 204 may be a plurality of collinear wave-directing members 208, each with sizes similar or different from other wave-directing members. In line with the description above, the first ends 206 of the elongated segments 204 may be referred to herein as a first half of wave-radiating channels.

At a second end 210 of the channels 202 opposite the first end 206, one of the elongated segments 204 may include a through-hole 212 (i.e., input port). A given amount of power may be used to feed a corresponding amount of electromagnetic waves (i.e., energy) into the apparatus, and the through-hole 212 may be the location where these waves are fed into the apparatus. In line with the description above, the single channel/segment of the waveguide channels 202 that includes the input port may be referred to herein as an input waveguide channel.

Upon entering the apparatus, the electromagnetic waves may generally travel in the +x direction, as shown, towards an array of power dividers 214 (i.e., a "beam-forming network"). The array 214 may function to divide up the electromagnetic waves and propagate respective portions of the waves to respective first ends 206 of each elongated segment 204. More specifically, the waves may continue to propagate in the +x direction after leaving the array 214 toward the wave-directing members 208. In line with the description above, the array 214 section of the waveguide channels may be referred to herein as wave-dividing channels.

As the portions of the electromagnetic waves reach the wave-directing members 208 at the first end 206 of each elongated segment 204 of the waveguide channels 202, the wave-directing members 208 may propagate through respective sub-portions of the electromagnetic energy to a second half of the waveguide channels (i.e., in the +z direction, as shown). For instance, the electromagnetic energy may first reach a wave-directing member that is recessed, or machined further into the first metal layer 200 (i.e., a pocket). That recessed member may be configured to propagate a smaller fraction of the electromagnetic energy than each of the subsequent members further down the first end 206, which may be protruding members rather than recessed members. Further, each subsequent member may be configured to propagate a greater fraction of the electromagnetic waves travelling down that particular elongated segment 204 at the first end 206 than the member that came before it. As such, the member at the far end of the first end 206 may be configured to propagate the highest fraction of electromagnetic waves. Each wave-directing member 208 may take various shapes with various dimensions. In other examples, more than one member (or none of the members) may be recessed. Still other examples are possible as well. In addition, varying quantities of elongated segments are possible.

A second metal layer may contain a second half of the one or more waveguide channels, where respective portions of the second half of the one or more waveguide channels include an elongated segment substantially aligned with the elongated segment of the first half of the one or more waveguide channels and, at an end of the elongated segment, at least one pair of through-holes partially aligned with the at least one wave-directing member and configured to radiate electromagnetic waves propagated from the at least one wave-directing member out of the second metal layer.

Within examples, the elongated segment of the second half may be considered to substantially align with the elongated segment of the first half when the two segments are within a threshold distance, or when centers of the segments are within a threshold distance. For instance, if the centers of the two segments are within about ±0.051 mm of each other, the segment may be considered to be substantially aligned.

In another example, when the two halves are combined (i.e., when the two metal layers are joined together), edges of the segments may be considered to be substantially aligned if an edge of the first half of a segment and a corresponding edge of the second half of the segment are within about ±0.051 mm of each other.

In still other examples, when joining the two metal layers, one layer may be angled with respect to the other layer such that their sides are not flush with one another. In such other examples, the two metal layers, and thus the two halves of the segments, may be considered to be substantially aligned when this angle offset is less than about 0.5 degrees.

In some embodiments, the at least one pair of through-holes may be perpendicular to the elongated segments of the second half of the one or more waveguide channels. Further, respective pairs of the at least one pair of through-holes may include a first portion and a second portion. As such, a given pair of through-holes may meet at the first portion to form a single channel. That single channel may be configured to receive at least the portion of electromagnetic waves that was propagated by a corresponding wave-directing member and propagate at least a portion of electromagnetic waves to the second portion. Still further, the second portion may include two output ports configured as a doublet and may be configured to receive at least the portion of electromagnetic waves from the first portion of the pair of through-holes and propagate at least that portion of electromagnetic waves out of the two output ports.

FIG. 2B illustrates the second metal layer 220 described above. The second metal layer 220 may include a second half of the plurality of waveguide channels 202 of the first metal layer 200 shown in FIG. 2A (i.e., a second half of the input waveguide channel, the wave-dividing channels, and the wave-radiating channels). As shown, the second half of the waveguide channels 202 may take on the general form of the first half of the channels, so as to facilitate proper alignment of the two halves of the channels. The elongated segments of the second half 222 may include second halves of the array of power dividers 224. As described above, electromagnetic waves may travel through the array 224, where they are divided into portions, and the portions then travel (i.e., in the +x direction, as shown) to respective ends 226 of the second halves of the elongated segments 222. Further, an end 226 of a given elongated segment may include multiple pairs of through-holes 228, which may be at least partially aligned with the wave-directing members 208 of the first metal layer 200. More specifically, each pair of through-holes may be at least partially aligned with a corresponding wave-directing member, also referred to as a reflecting element, such that when a given sub-portion of electromagnetic waves are propagated from the first metal layer 200 to the second metal layer 220, as described above, those sub-portions are then radiated out of the pair of through-holes (i.e., a pair of output ports) in the −z direction, as shown. Again, the combination of a given wave-directing member and a corresponding pair of output ports may form a DOEWG, as described above.

Moreover, a combination of all the DOEWGs may be referred to herein as a DOEWG array. In antenna theory, when an antenna has a larger radiating aperture (i.e., how much effective surface area of the antenna radiates, where the surface area includes at least the DOEWG array) that antenna may have higher gain (dB) and a narrower beam width. As such, in some embodiments, a higher-gain antenna may include more channels (i.e., elongated segments), with more DOEWGs per channel. While the example antenna illustrated in FIGS. 2A and 2B may be suitable for autonomous-vehicle purposes (e.g., six elongated segments, with five DOEWGs per segment), other embodiments may be possible as well, and such other embodiments may be designed/machined for various applications, including, but not limited to, automotive radar.

For instance, in such other embodiments, an antenna may include a minimum of a single DOEWG. With this arrangement, the output ports may radiate energy in all directions (i.e. low gain, wide beamwidth). Generally, an upper limit of segments/DOEWGs may be determined by a type of metal used for the first and second metal layers. For example, metal that has a high resistance may attenuate an electromagnetic wave as that wave travels down a waveguide channel. As such, when a larger, highly-resistive antenna is designed (e.g., more channels, more segments, more DOEWGs, etc.), energy that is injected into the antenna via the input port may be attenuated to an extent where not much energy is radiated out of the antenna. Therefore, in order to design a larger antenna, less resistive (and more conductive) metals may be used for the first and second metal layers. For instance, in embodiments described herein, at least one of the first and second metal layers may be aluminum. Further, in other embodiments, at least one of the first and second metal layers may be copper, silver, or another conductive material. Further, aluminum metal layers may be plated with copper, silver, or other low-resistance/high-conductivity materials to increase antenna performance. Other examples are possible as well.

The antenna may include at least one fastener configured to join the first metal layer to the second metal layer so as to align the first half of the one or more waveguide channels with the second half of the one or more waveguide channels to form the one or more waveguide channels (i.e., align the first half of the plurality of wave-dividing channels with the second half of the plurality of wave-dividing channels, and align the first half of the plurality of wave-radiating channels with the second half of the plurality of wave-radiating channels). To facilitate this in some embodiments, the first metal layer, a first plurality of through-holes (not shown in FIG. 2A) may be configured to house the at least one fastener. Additionally, in the second metal layer, a second plurality of through-holes (not shown in FIG. 2B) may be substantially aligned with the first plurality of through-holes and configured to house the at least one fastener for joining the second metal layer to the first metal layer. In such embodiments, the at least one fastener may be provided into the aligned first and second pluralities of through-holes and secured in a manner such that the two metal layers are joined together.

In some examples, the at least one fastener may be multiple fasteners. Mechanical fasteners (and technology used to facilitate fastening) such as screws and alignment pins may be used to join (e.g., screw) the two metal layers together. Further, in some examples, the two metal layers may be joined directly to each other, with no adhesive layer in between. Still further, the two metal layers may be joined together using methods different than adhesion, diffusion bonding, soldering, brazing, and the like. However, it is possible that, in other examples, such methods may be used in addition to or alternative to any methods for joining metal layers that are known or not yet known.

In some embodiments, one or more blind-holes may be formed into the first metal layer and/or into the second metal layer in addition to or alternative to the plurality of through-holes of the first and/or the second metal layer. In such embodiments, the one or more blind-holes may be used for fastening (e.g., housing screws or alignment pins) or may be used for other purposes.

FIG. 2C illustrates an assembled view of an example antenna 240. The example antenna 240 may include the first metal layer 200 and the second metal layer 220. The second metal layer 220 may include a plurality of holes 242 (through-holes and/or blind-holes) configured to house alignment pins, screws, and the like. The first metal layer 200 may include a plurality of holes as well (not shown) that are aligned with the holes 242 of the second metal layer 220.

Further, FIG. 2C illustrates a DOEWG array 244 of a given width 246 and a given length 248, which may vary based on the number of DOEWGs and channels of the antenna 240. For instance, in an example embodiment, the DOEWG array may have a width of about 11.43 mm and a length of about 28.24 mm. Further, in such an example embodiment, these dimensions, in addition to or alternative to other dimensions of the example antenna 240, may be machined with no less than about a 0.51 mm error, though in other embodiments, more or less of an error may be required. Other dimensions of the DOEWG array are possible as well.

In some embodiments, the first and second metal layers 200, 220 may be machined from aluminum plates (e.g., about 6.35 mm stock). In such embodiments, the first metal layer 200 may be at least 3 mm in thickness (e.g., about 5.84 mm to 6.86 mm). Further, the second metal layer 220 may be machined from a 6.35 mm stock to a thickness of about 3.886 mm. Other thicknesses are possible as well.

In some embodiments, the joining of the two metal layers 200, 220 may result in an air gap or other discontinuity between mating surfaces of the two layers. In such embodiments, this gap or continuity should be proximate to (or perhaps as close as possible to) a center of the length of the antenna apparatus and may have a size of about 0.05 mm or smaller.

FIG. 2D illustrates another assembled view of the example antenna 240. As shown, the first metal layer 200 may include a plurality of holes 250 (through-holes and/or blind-holes) configured to house alignment pins, screws, and the like. One or more of the plurality of holes 250 may be aligned with the holes 242 of the second metal layer 220. Further, FIG. 2D shows the input port 212, where the antenna 240 may receive electromagnetic waves into the one or more waveguide channels 202.

FIG. 2E illustrates conceptual waveguide channels 260 formed inside an assembled example antenna. More particularly, the waveguide channels 260 take the form of the waveguide channels 202 of FIGS. 2A and 2B. For instance, the channels 260 include an input port 262 to the input waveguide channel 264. The channels 260 also include wave-dividing channels 266 and a plurality of radiating doublets 268 (i.e., a DOEWG array). As described above, when electromagnetic waves enter the channels 260 at the input port 262, they may travel in the +x direction through the input waveguide channel 264 and be divided into portions by the wave-dividing channels 266 (e.g., by the power dividers). Those portions of electromagnetic waves may then travel in the +x direction to respective radiating doublets 268, where sub-portions of those portions are radiated out each DOEWG through pairs of output ports, such as pair 270, for instance.

In a particular wave-radiating channel, a portion of electromagnetic waves may first be propagated through a first DOEWG with a recessed wave-directing member 272 (i.e., an inverse step, or "well"), as discussed above. This recessed wave-directing member 272 may be configured to radiate the smallest fraction of energy of all the members of the DOEWGs of the particular wave-radiating channel. In some examples, subsequent wave-directing members 274 may be formed (e.g., protruded, rather than recessed) such that each subsequent DOEWG can radiate a higher fraction of the remaining energy than the DOEWG that came before it. Phrased another way, each wave-directing member 272, 274 may generally be formed as a "step cut" into a horizontal (+x direction) channel (i.e., a wave-radiating channel, or the "first end" of an "elongated segment" as noted above) and used by the antenna to tune the amount of energy that is radiated vs. the amount of energy that is transmitted further down the antenna.

In some embodiments, a given DOEWG may not be able to radiate more than a threshold level of energy and may not be able to radiate less than a threshold level of energy. These thresholds may vary based on the dimensions of the DOEWG components (e.g., the wave-directing member, a horizontal channel, a vertical channel, a bridge between the two output ports, etc.), or may vary based on other factors associated with the antenna.

In some embodiments, the first and second metal layers may be machined such that various sides of the waveguide channels 260 have rounded edges, such as edge 276, 278, and 280, for example.

Figure 3A:
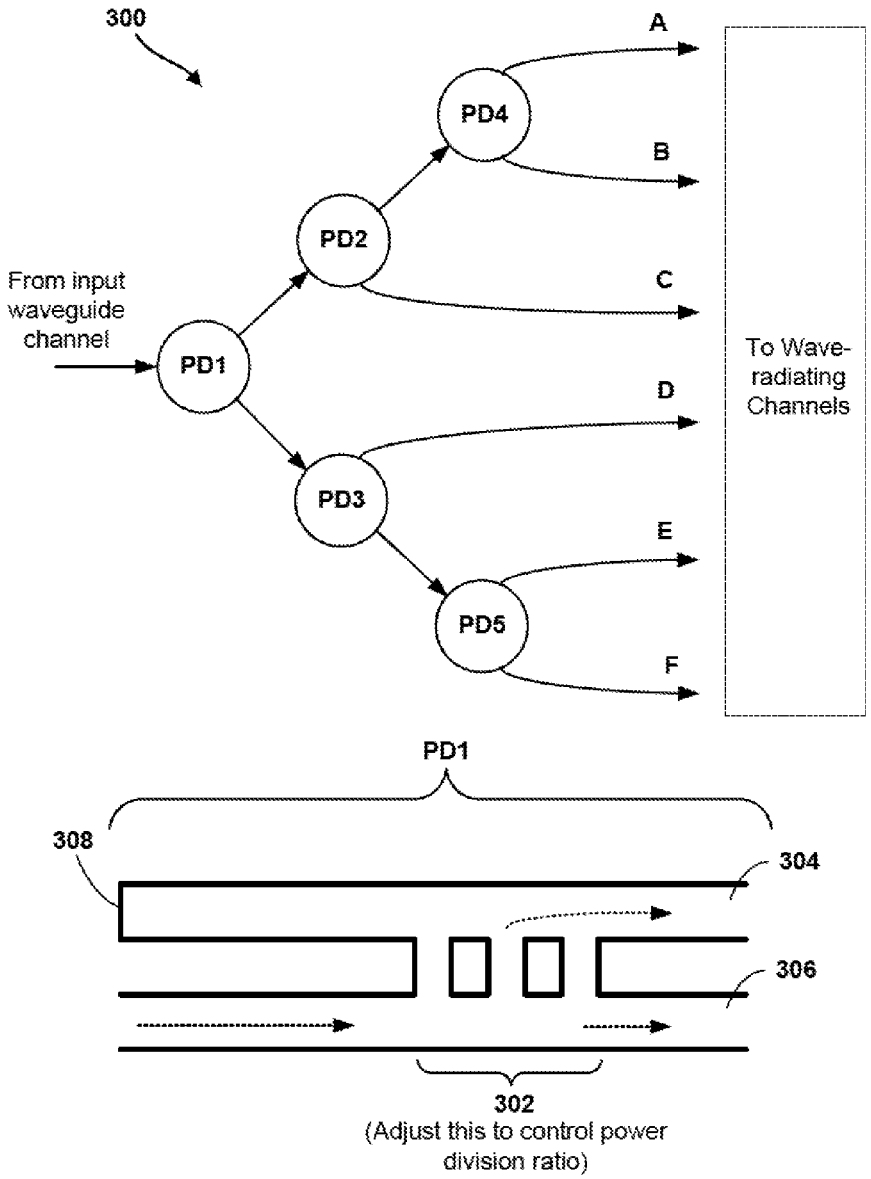
FIG. 3A illustrates a network of wave-dividing channels of an example antenna, in accordance with an example embodiment.
Figure 3B:
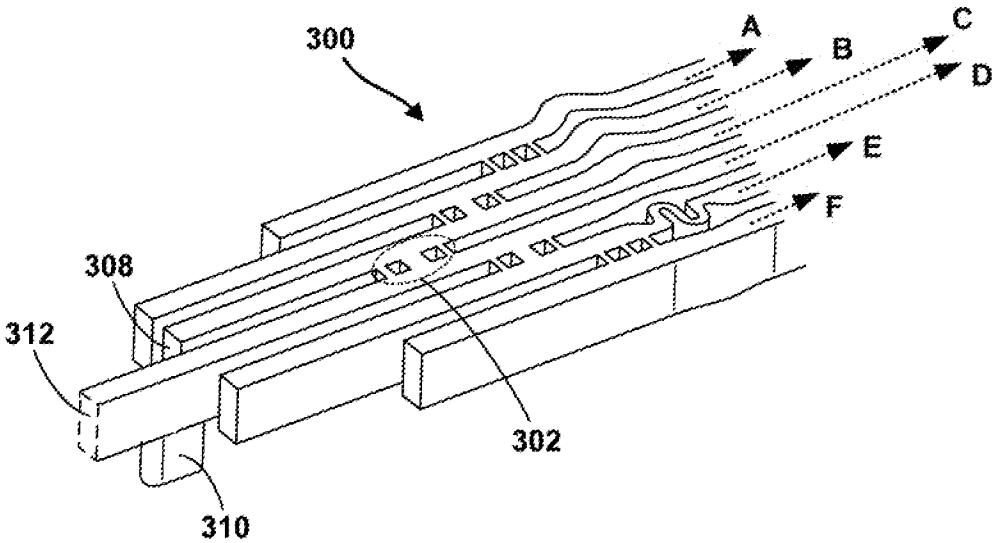
FIG. 3B illustrates an alternate view of the network of wave-dividing channels of FIG. 3A, in accordance with an example embodiment.

FIG. 3A illustrates a network of wave-dividing channels 300 of an example antenna, in accordance with an example embodiment. And FIG. 3B illustrates an alternate view of the network of wave-dividing channels 300, in accordance with an example embodiment. For the offset fed antenna of the present disclosure, the junction divider may be similar to 1×2 divider PD1. For example, an offset feed may feed a signal into a waveguide and the signal may be split into two signals after the offset feed. Thus, the offset feed can be consider to be a hybrid power dividing mechanism comprised of parallel and series dividers.

In some embodiments, the network (e.g., beam-forming network, as noted above) of wave-dividing channels 300 may take the form of a tree of power dividers, as shown in FIG. 3A. Energy may enter the antenna through the input waveguide channel and is divided (i.e., split) into smaller portions of energy at each power divider, such as power divider 302, and may be divided multiple times via subsequent power dividers so that a respective amount of energy is fed into each of the wave-radiating channels (energy A-F, as shown). The amount of energy that is divided at a given power divider may be controlled by a power division ratio (i.e., how much energy goes into one channel 304 versus how much energy goes into another channel 306 after the division). A given power division ratio may be adjusted based on the dimensions of the corresponding power divider. Further, each power divider and associated power division ratio may be designed/calculated in order to achieve a desired "power taper" at the wave-radiating channels. In such a case, the antenna may be designed with a "Taylor window" (e.g., radiation ripples drop off at edges) or other window such that sidelobes of the antenna's far-field radiation pattern may be low. As an example, the power division ratios of the power dividers may be set such that energy portions A, B, C, D, E, and F are approximately 3.2%, 15.1%, 31.7%, 31.7%, 15.1%, 3.2% of the energy, respectively. Other example power divisions are possible as well.

Although FIG. 3B illustrates the feed of the BFN feeding the DOEWG arrays linear arrays from the end, the present inventions provides an alternative method of connecting this BFN from the an offset point. For example, the feed may be moved to a different point along the bottom of the the DOEWG array. Further, the feed may be also be moved to a different point along the bottom of the the beamforming network of waveguides.

Within examples, a technique for dividing energy between two channels 304, 306 may be to use a structure of channels (e.g., a four-port branchline coupler) such as that shown at the bottom of FIG. 3A. Such a technique and structure design may include a "terminator" 308 at the end of a channel, as shown in FIGS. 3A and 3B, where small wedges of radio frequency-absorbing material may be located to absorb energy that returns backwards through the channel to that terminator 308. Further, the channels may include an offset feed 310 as described herein. The offset feed may be located as a position along a waveguide that is offset from the end 312. For example, the end 312 may have a portion of its length that extends away from the beamform network on the opposite side of the feed 310 from the beamforming network.

Figure 4A:
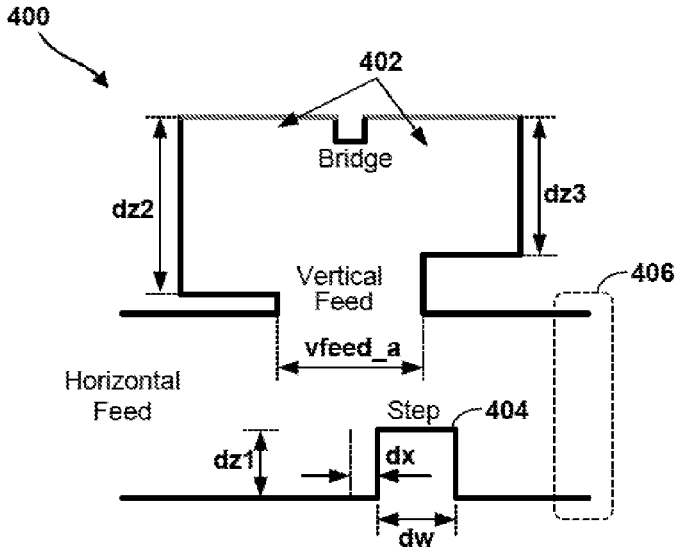
FIG. 4A illustrates an example wave-radiating portion of an example antenna, in accordance with an example embodiment.
Figure 4B:
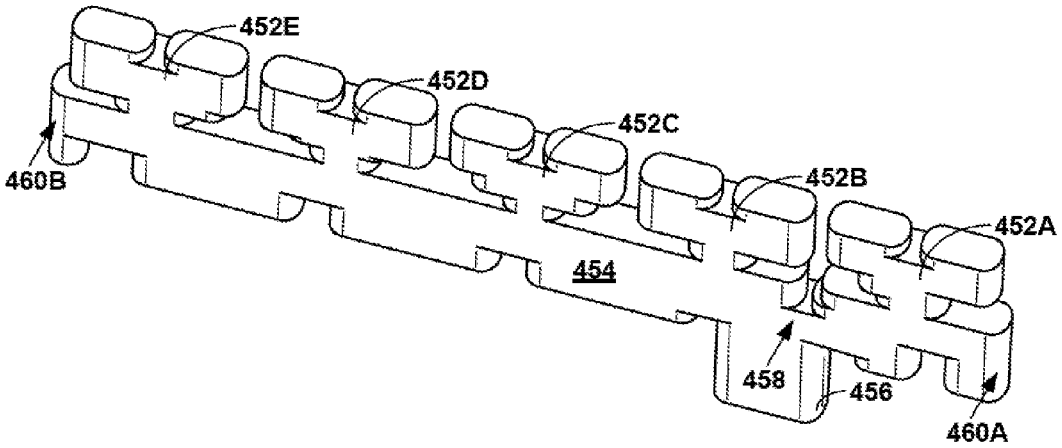
FIG. 4B illustrates an example offset feed waveguide portion of an example antenna, in accordance with an example embodiment.

FIG. 4A illustrates an example wave-radiating doublet of an example antenna, in accordance with an example embodiment. More specifically, FIG. 4A illustrates a cross-section of an example DOEWG 400. As noted above, a DOEWG 400 may include a horizontal feed (i.e., channel), a vertical feed (i.e. a doublet neck), and a wave-directing member 404. The vertical feed may configured to couple energy from the horizontal feed to two output ports 402, each of which is configured to radiate at least a portion of electromagnetic waves out of the DOEWG 400. In some embodiments, the farthest DOEWG from the input port may include a back-stop at location 406. DOEWGs that come before the last DOEWG may simply be open at location 406 and electromagnetic waves may propagate through that location 406 to subsequent DOEWGs. For example, a plurality of DOEWGs may be connected in series where the horizontal feed is common across the plurality of DOEWGs (as shown in FIG. 4B). FIG. 4A shows various parameters that may be adjusted to tune the amplitude and/or phase of an electromagnetic signal that couples into the radiating element.

In order to tune a DOEWG such as DOEWG 400, the vertical feed width, vfeed_a, and various dimensions of the step 404 (e.g., dw, dx, and dz1) may be tuned to achieve different fractions of radiated energy out the DOEWG 400. The step 404 may also be referred to as a reflecting component as it reflects a portion of the electromagnetic waves that propagate down the horizontal feed into the vertical feed. Further, in some examples, the height dz1 of the reflecting component may be negative, that is may extend below the bottom of the horizontal feed. Similar tuning mechanisms may be used to tune the offset feed as well. For example, the offset feed may include any of the vertical feed width, vfeed_a, and various dimensions of the step (e.g., dw, dx, and dz1) as discussed with respect to the radiating element.

In some examples, each output port 402 of the DOEWG 400 may have an associated phase and amplitude. In order to achieve the desired phase and amplitude for each output port 402, various geometry components may be adjusted. As previously discussed, the step (reflecting component) 404 may direct a portion of the electromagnetic wave through the vertical feed. In order to adjust an amplitude associated with each output port 402 of a respective DOEWG 400, a height associated with each output port 402 may be adjusted.

Further, the height associated with each output port 402 could be the height or the the depths of this feed section of output port 402, and not only could be a height or depth adjustment but it could be a multiplicity of these changes or steps or ascending or descending heights or depths in general.

As shown in FIG. 4A, height dz2 and height dz3 may be adjusted to control the amplitude with respect to the two output ports 402. The adjustments to height dz2 and height dz3 may alter the physical dimensions of the doublet neck (e.g. vertical feed of FIG. 4A). The doublet neck may have dimensions based on the height dz2 and height dz3. Thus, as the height dz2 and height dz3 are altered for various doublets, the dimensions of the doublet neck (i.e. the height of at least one side of the doublet neck) may change. In one example, because height dz2 is greater than height dz3, the output port 402 associated with (i.e. located adjacent to) height dz2 may radiate with a greater amplitude than the amplitude of the signal radiated by the output port 402 associated with height dz3.

Further, in order to adjust the phase associated with each output port 402, a step 410A and 410B may be introduced for each output port 402. The step 410A and 410B in the height may cause a phase of a signal radiated by the output port 402 associated with the step to change. Thus, by controlling both the height and the step 410A and 410B associated with each output port 402, both the amplitude and the phase of a signal transmitted by the output port 402 may be controlled. In various examples, the step 410A and 410B may take various forms, such as a combination of up-steps and down-steps. Additionally, the number of steps 410A and 410B may be increased or decreased to control the phase.

The above-mentioned adjustments to the geometry may also be used to adjust a geometry of the offset feed where it connects to the waveguide. For example, heights, widths, and steps may be adjusted or added to the offset feed in order to adjust the radiation properties of the system. An impedance match, phase control, and/or amplitude control may be implemented by adjusting the geometry of the offset feed.

FIG. 4B illustrates an example offset feed waveguide portion 456 of an example antenna, in accordance with an example embodiment. As shown in FIG. 4B, a waveguide 454 may includes a plurality of radiating elements (shown as 452A-452E) and an offset feed 456. Although the plurality of radiating elements are shown as doublets in FIG. 4B, other radiating structures may be use as well. For example, singlets, and any other radiating structure that can be coupled to a waveguide may be used as well.

The waveguide 454 may be configured in a similar manner the those waveguides discussed throughout this disclosure. For example, the waveguide 454 may includes various shapes and structures configured to direct electromagnetic power to the various radiating elements 452A-E of waveguide 454. As discussed with respect to FIG. 2E, a portion of electromagnetic waves propagating through waveguide 454 may be divided and directed by by various recessed wave-directing member (272 of FIG. 2E) and raised wave-directing members (274 of FIG. 2E). The pattern of wave-directing members shown in FIG. 4B is one example for the wave-directing members. Based on the specific implementation, the wave-directing members may have different sizes, shapes, and locations. Additionally, the waveguide may be designed to have the waveguide ends 460A and 460B to be tuned shorts. For example, the geometry of the ends of the waveguides may be adjusted so the waveguide ends 460A and 460B act as tuned shorts.

At each junction of a respective radiating elements 452A-E of waveguide 454, the junction may be considered a two way power divider. A percentage of the electromagnetic power may couple into the neck of the respective radiating elements 452A-E and the remaining electromagnetic power may continue to propagate down the waveguide. By adjusting the various parameters (e.g. neck width, heights, and steps) of each respective radiating element 452A-E, the respective percentage of the electromagnetic power may be controlled. Thus, the geometry of each respective radiating element 452A-E may be controlled in order to achieve the desired power taper. Thus, by adjusting the geometry of each of the offset feed and the each respective radiating element 452A-E, the desired power taper for a respective waveguide and its associated radiating elements may be achieved.

Electromagnetic energy may be injected into the waveguide 454 via the waveguide feed 456. The waveguide feed 456 may be a port (i.e. a through hole) in a bottom metal layer. An electromagnetic signal may be coupled from outside the antenna unit into the waveguide 454 through the waveguide feed 456. The electromagnetic signal may come from a component located outside the antenna unit, such as a printed circuit board, another waveguide, or other signal source. In some examples, the waveguide feed 456 may be coupled to another dividing network of waveguides (such as or similar to the dividing networks described with respect to FIGS. 2A, 2B, and 2E).

In some additional examples, the various radiating elements 452A-E may be configured to receive electromagnetic energy. In these examples, the waveguide feed 456 may be used to remove electromagnetic energy from the waveguide 454. When electromagnetic energy is removed from the waveguide 454, it may be coupled into components for further processing.

In many traditional examples, a waveguide feed is located at the end of a waveguide. In the example shown in FIG. 4B, the waveguide feed 456 is located at an offset position from the ends of the waveguide between radiating elements 452A and 452B. By locating the waveguide feed 456 at an offset position, the electromagnetic energy that couples into the waveguide 454 may be divided more easily. Further, by locating the waveguide feed 456 at an offset position, an antenna unit may be designed in a more compact manner.

When electromagnetic energy enters waveguide 454, it will be split in order to achieve a desired radiation pattern. For example, it may be desireable for each of a series of radiating elements 452A-E to receive a predetermined percentage of the electromagnetic energy from the waveguide 454. The waveguide may include a power dividing element 458 that is configured to split the electromagnetic energy the travels down each side of the waveguide. In some examples, the power dividing element 458 may cause the power to be divided evenly or unevenly. The radiating elements 452A-E are configured to radiate the electromagnetic energy they receive. In some examples, each radiating element 452A-E may receive approximately the same percentage of the electromagnetic energy as each other radiating element 452A-E. In other examples, each radiating element 452A-E may receive a percentage of the electromagnetic energy based on a taper profile.

In some example taper profiles, radiating elements 452A-E located closer to the center of waveguide 454 may receive a higher percentage of the electromagnetic energy. If electromagnetic energy is injected into the end of the waveguide 454, it may be more difficult to design the waveguide 454 to correctly split power between the various radiating elements 452A-E. By locating the waveguide feed 456 at an offset position, a more natural power division between the various radiating elements 452A-E may be achieved. The offset position for the waveguide feed 456 may be any position along the waveguide 454 where the waveguide feed 456 is location corresponding to a position at or between some of the radiating elements.

In one example, the waveguide 454 may have 10 radiating elements and the waveguide feed 456 may be located in at a position with 5 radiating elements on each side of the waveguide feed 456. The radiating elements may have an associated taper profile that specifies the radiating elements in the center should receive a higher percentage of the electromagnetic energy than the other elements. Because the waveguide feed 456 is located closer to the center elements, it is more natural to divide power with elements closest to the waveguide feed 456 receiving higher power. Further, if the waveguide 454 has the waveguide feed 456 located at the center of the waveguide 454, the waveguide 454 may be designed in a symmetrical manner to achieve the desired power division. In examples where the waveguide feed 456 is located away from the center of the radiating elements, the waveguide 454 may be designed to split the power in an uneven (i.e. non-symmetric) manner.

In some examples, the present system may operate in one of two modes. In the first mode, the system may receive electromagnetic energy from a source for transmission (i.e. the system may operate as a transmission antenna). In the second mode, the system may receive electromagnetic energy from outside of the system for processing (i.e. the system may operate as a reception antenna). In the first mode, the system may receive electromagnetic energy at a waveguide feed, divide the electromagnetic energy for transmission by a plurality of radiating elements, and radiate the divided electromagnetic energy by the radiating elements. In the second mode, the system may receive electromagnetic energy at the plurality of radiating elements, combine the received electromagnetic energy, and couple the combined electromagnetic energy out of system for further processing.

It should be understood that other shapes and dimensions of the waveguide channels, portions of the waveguide channels, sides of the waveguide channels, wave-directing members, and the like are possible as well. In some embodiments, a rectangular shape of waveguide channels may be highly convenient to manufacture, though other methods known or not yet known may be implemented to manufacture waveguide channels with equal or even greater convenience.

It should be understood that arrangements described herein are for purposes of example only. As such, those skilled in the art will appreciate that other arrangements and other elements (e.g. machines, apparatuses, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the scope being indicated by the following claims.

What is claimed is:

1. A radar system comprising:

a plurality of radiating elements arranged in a linear array, wherein the radiating elements are configured to radiate electromagnetic energy;

a waveguide configured to guide electromagnetic energy between (i) each of the plurality of radiating elements and (ii) a waveguide feed, wherein the waveguide has a height dimension and a length dimension, wherein the waveguide has a first side and a second side opposite the first side, wherein the first and second sides are orthogonal to the height dimension and parallel to the length dimension, and wherein the radiating elements are coupled to the first side of the waveguide;

the waveguide feed is configured to couple electromagnetic energy between the waveguide and a component external to the waveguide, wherein the waveguide feed is coupled to the second side of the waveguide at a location along the length dimension of the waveguide corresponding to a position between two of the radiating elements; and a power dividing network defined by the waveguide and configured to divide the electromagnetic energy coupled by the waveguide feed based on a taper profile, wherein each radiating element receives a portion of the electromagnetic energy based on the taper profile.

2. The radar system according to claim 1, wherein the waveguide feed is aligned orthogonally to the length of the waveguide.

3. The radar system according to claim 1, wherein the waveguide feed has a location along the length dimension of the waveguide having an equal number of radiating elements on each side.

4. The radar system according to claim 1, wherein the plurality of radiating elements is configured as a plurality of radiating doublets.

5. The radar system according to claim 1, wherein the power dividing network is configured to unevenly divide the power from the waveguide feed.

6. The radar system according to claim 1, wherein the waveguide feed is coupled to a beamforming network, wherein the beamforming network is coupled to a plurality of respective waveguides and each waveguide has a respective plurality of radiating elements.

7. The radar system according to claim 1, wherein the first side of the waveguide is a top side of the waveguide and the second side of the waveguide is a bottom side of the waveguide.

8. The radar system of claim 1, wherein the waveguide feed couples to the waveguide at a junction, and wherein the junction is configured to divide power based on a geometry of at least one of the waveguide feed and the waveguide.

9. A method of radiating a radar signal comprising:

propagating electromagnetic energy via a waveguide between (i) each of a plurality of radiating elements and (ii) a waveguide feed, wherein the plurality of radiating elements is arranged in a linear array, wherein the waveguide has a height dimension and a length dimension, wherein the waveguide has a first side and a second side opposite the first side, wherein the first and second sides are orthogonal to the height dimension and parallel to the length dimension, and wherein the radiating elements are coupled to the first side of the waveguide;

coupling at least a portion of the electromagnetic between the waveguide and a component external to the waveguide by a waveguide feed, wherein the waveguide feed is coupled to the second side of the waveguide at a location along the length dimension of the waveguide corresponding to a position between two of the radiating elements;

dividing the electromagnetic energy from the waveguide feed based on a taper profile, wherein each radiating element receives a portion of the electromagnetic energy based on the taper profile; and radiating at least a portion of the coupled electromagnetic energy via each radiating element, wherein each radiating element has an associated amplitude and phase defined by the taper profile.

10. The method according to claim 9, wherein the waveguide feed is aligned orthogonally to the length of the waveguide.

11. The method according to claim 9, wherein the waveguide feed has a location along the length dimension of the waveguide having an equal number of radiating elements on each side.

12. The method according to claim 9, wherein the plurality of radiating elements is configured as a plurality of radiating doublets.

13. The method according to claim 9, wherein dividing the electromagnetic energy from the waveguide feed based on a taper profile unevenly divides the power from the waveguide feed.

14. The method according to claim 9, wherein dividing the electromagnetic energy from the waveguide feed further comprises a beamforming network dividing the electromagnetic energy to a plurality of waveguides.

15. The method according to claim 9, wherein the first side of the waveguide is located in a first portion of a split block and the second side of the waveguide is located in a second portion of the split block.

* * * * *